US005743199A

United States Patent [19]

Odaka et al.

[11] Patent Number: 5,743,199

[45] Date of Patent: Apr. 28, 1998

[54] FEEDING MECHANISM OF EYELET-END BUTTONHOLE SEWING MACHINE

[75] Inventors: Yoshiyuki Odaka; Takeshi Yoshida, both of Utsunomiya, Japan

[73] Assignee: The Singer Company N.V., Curaco, Netherlands Antilles

[21] Appl. No.: 814,914

[22] Filed: Mar. 12, 1997

[30] Foreign Application Priority Data

May 10, 1996 [JP] Japan ..... 8-140742

[51] Int. Cl.[6] ..... D05B 3/08

[52] U.S. Cl. ..... 112/66

[58] Field of Search ..... 112/65, 66, 67, 112/69, 470.09

[56] References Cited

U.S. PATENT DOCUMENTS

| | | | |
|---|---|---|---|
| 2,938,477 | 5/1960 | Graham et al. | 112/67 |
| 4,570,555 | 2/1986 | Reinke et al. | 112/67 |
| 5,010,832 | 4/1991 | Hiratsuka et al. | 112/65 X |

FOREIGN PATENT DOCUMENTS 2059778 5/1990 Japan .

*Primary Examiner*—Ismael Izaguirre
*Attorney, Agent, or Firm*—McCormick, Paulding & Huber

[57] ABSTRACT

A feeding mechanism of an eyelet-end buttonhole sewing machine comprising a bed shaft rotatably supported by a bed, a rapid feed shaft rotatably supported by the bed, a pattern wheel shaft being rotatably supported by the bed and driven by the rapid feed shaft, and a feed wheel being rotatably supported by the bed and driven by the pattern wheel shaft for giving rapid feed to a cloth to be sewn in a forward and backward direction, and also being rotatably driven by the bed shaft for giving rapid feed to the cloth to be sewn in a forward and backward direction involved in a sewing step, the feeding mechanism further comprising a rotary driving source being rotatably driven normally and reversely, a bed shaft rotary member being rotatably driven normally and reversely by the rotary driving source, a rapid feed rotary member being fixed to the rapid feed shaft and retained by the bed shaft rotary member so as to be reversely rotated therewith, a one way sewing clutch for transmitting only a normal rotation of the bed shaft rotary member to the bed shaft, and a one way rapid feed clutch for transmitting only a reverse rotation of the bed shaft rotary member to the pattern wheel shaft by way of the rapid feed rotary member and the rapid feed shaft.

3 Claims, 6 Drawing Sheets

FEEDING MECHANISM OF EYELET-END BUTTONHOLE SEWING MACHINE

BACKGROUND OF THE INVENTION

1. Field of the Invention

The present invention relates to a feeding mechanism of an eyelet-end buttonhole sewing machine.

2. Prior Art

In a conventional eyelet-end buttonhole sewing machine, an eyelet-end button hole is subject to an overlock stitch Y as shown in FIG. 3. The operation of the eyelet-end buttonhole sewing machine is started from a machine stopping position X, and continues in the order of a start—a first rapid feed step—a sewing step—a second rapid feed step—stop. The length of the overlock stitch Y in the sewing step is changed by changing the length of the first and second rapid feed steps. It is desired to quicken the rapid feed so as to speed up the sewing operation, and the cloth to be sewn is required to be accurately fed by one pitch conforming to the vertical movement of a needle and a needle bar.

Such a feeding mechanism of the eyelet-end buttonhole sewing machine comprises a bed shaft rotatably supported by a bed, a rapid feed shaft rotatably supported by the bed, a pattern wheel shaft being rotatably driven by the rapid feed shaft, and a feed wheel being rotatably supported by the bed and rotatably driven by the pattern wheel shaft for giving a rapid feed to a cloth to be sewn in a forward and backward direction, and also being rotatably driven by the bed shaft for giving a rapid feed to the cloth to be sewn in a forward and backward direction involved in the sewing step.

However, in the conventional feeding mechanism of the eyelet-end buttonhole sewing machine, since a general purpose induction motor is mainly used as a rotary driving source, there is a technical problem that a reverse rotation and positioning by the motor is not easily performed. Further, there is provided a mechanical or electrical clutch in a mechanism for carrying out the first and second rapid feed steps and that for carrying out the sewing step when the first rapid feed step—the sewing step—the second rapid feed step are performed (for example, as disclosed in JP-U 2-059778, and a complex mechanism for engaging or disengaging the clutch is required, which causes a serious problem in a cost performance and a reliability thereof.

A feeding mechanism of a conventional eyelet-end buttonhole sewing machine will be now described with reference to FIG. 4. In this mechanism, a pulley 2 is rotatably driven in one way (in the direction of an arrow a shown in FIG. 4) by an induction motor 60 which always rotates in one direction by way of a belt 50 during the operation of this sewing machine. A bed shaft gear 3 comprising a spur gear is fixed to the pulley 2, and the pulley 2 and the bed shaft gear 3 are rotatably supported by a bed shaft 17 by way of bearings 4. The bed shaft 17 is horizontally disposed on a bed 52 of the sewing machine by way of a plurality of bearings 10, 10', and it is rotatable.

The rotation of the pulley 2 and the bed shaft gear 3 which are respectively rotated by the induction motor 60 in the direction of the arrow a shown in FIG. 4 is transmitted to a rapid feed shaft gear 20 by way of an idle gear 21 so as to always rotate a rapid feed shaft 23 which is fixed to the rapid feed shaft gear 20 in the direction of the arrow a shown in FIG. 4. The rapid feed shaft 23 is rotatably supported by a bed extension (not shown) attached to the lower portion of the bed 52 by way of a plurality of bearings 22, 22', and it is disposed in parallel with the bed shaft 17. A worm 24 which is fixed to the rapid feed shaft 23 meshes a worm wheel 25 to which a mechanical clutch 27 is integrally fixed. The clutch 27 is operated by an external motive force for engaging or disengaging between the worm wheel 25 and a pattern wheel shaft 26.

The worm wheel 25 is rotatably supported by the pattern wheel shaft 26 by way of bearings 45, so that the worm wheel 25 and the pattern wheel shaft 26 are integrally rotated when it engages with the clutch 27. A pattern wheel shaft gear 28 comprising a bevel gear is fixed to one end of the pattern wheel shaft 26, and a pattern wheel 51 is fixed to the other end of the pattern wheel shaft 26. The pattern wheel 51 moves a carrier (not shown) for moving the cloth to be sewn rightward and leftward by way of a known mechanism.

In the first rapid feed step, a mechanical clutch 5 is disengaged and also the clutch 27 is engaged, thereby rotating the pattern wheel shaft 26 in the direction of an arrow f. If the pattern wheel shaft 26 is rotated, the pattern wheel shaft gear 28 comprising a bevel gear and fixed to one end of the pattern wheel shaft 26 is rotated. If the pattern wheel shaft gear 28 is rotated, a feed wheel 30 having a bevel gear 30*a* at the outer peripheral surface thereof which meshes the pattern wheel shaft gear 28 is rotated in the direction of an arrow c shown in FIG. 4. When the feed wheel 30 is rotated in the direction of the arrow c, a feed wheel ring 31 and a spur gear 37 are not respectively rotated by a function of a one way clutch 44, described later. A groove 32 having a given endless shape is defined in the rotating feed wheel 30, and a roller 34 which is rotatably attached to a carrier bar 33 is retained by the groove 32. The feed wheel 30 is rotatably supported by the bed 52.

When the feed wheel 30 is rotated in the direction of the arrow c shown in FIG. 4, the carrier bar 33 is swingably operated in the forward and backward direction (in the direction of an arrow d in FIG. 4) of the sewing machine along the groove 32. The carrier bar 33 is attached to the bed 52 so as to be rotatable about a shaft center 36 so that it operates the carrier, which moves the cloth to be sewn, in the forward and backward direction using a hole 35 defined in the tip end thereof. As a result, the first rapid feed step for moving the cloth to be sewn is performed.

When the sewing step is started upon completion of the first rapid feed step, the clutch 27 is disengaged. As a result, the rotation of the worm wheel 25 which is supported by the bearings 45 is not transmitted to the pattern wheel shaft 26 so that the rotation of the pattern wheel shaft 26 and the pattern wheel shaft gear 28 stops.

At the same time when the clutch 27 is disengaged, the mechanical clutch 5 attached to the bed shaft 17 is engaged. Accordingly, the bed shaft 17 is engaged with the pulley 2 and the bed shaft gear 3, and the bed shaft 17 starts to rotate in the direction of the arrow a shown in FIG. 4. When the bed shaft 17 rotates, an arm shaft 16 rotates by way of a bevel gear 11 fixed to the bed shaft 17, bevel gears 12 and 14 fixed to a vertical shaft 13, and a bevel gear 15 fixed to the arm shaft 16, so that a needle bar (not shown) connected to the arm shaft 16 and a looper (not shown) connected to the bed shaft 17 start to drive respectively. The vertical shaft 13 rotates in the direction of an arrow g.

At the same time, a driving roller for an intermittent feed driving wheel (not shown) mounted on the vertical shaft 13 rotates the intermittent fed driving wheel (not shown), so as to intermittently rotatably drive the spur gear 37 by way of several reduction gears in the direction of an arrow e. Accordingly, the rotatable driving of the spur gear 37 is performed at the same timing with the needle bar connected to the arm shaft 16. Since the spur gear 37 meshes teeth 31*a* defined in the outer periphery surface of the feed wheel ring 31, it intermittently rotates the feed wheel ring 31 in the direction of the arrow c shown in FIG. 4. The feed wheel ring 31 is rotatably supported by a plurality of ring supporters 42 attached to the feed wheel 30 to be coaxial with the feed wheel 30. The feed wheel 30 is integrally rotated with the feed wheel ring 31 while the feed wheel ring 31 is intermittently rotated in the direction of the arrow c by way of the one way clutch 44.

When the feed wheel ring 31 and the feed wheel 30 are intermittently rotated in the direction of the arrow c, the carrier bar 33 is swingably operated along the groove 32 of the feed wheel 30 in the forward and backward direction (in the direction of the arrow d in FIG. 4), thereby moving the carrier, which moves the cloth to be sewn, in the forward and backward direction using the hole 35 in the tip end as set forth above. As a result, the sewing step wherein the eyelet-end button hole is subject to the overlock stitch Y is carried out by the movement of the cloth to be sewn in the forward and backward direction while the needle bar connected to the arm shaft 16 and the looper connected to the bed shaft 17 are respectively driven. Meanwhile, the pattern wheel shaft gear 28 meshing the bevel gear 30*a* is also intermittently rotated by the intermittent rotation of the feed wheel 30 in the direction of the arrow c so that the pattern wheel shaft 26 and the pattern wheel 51 are intermittently rotated in the direction of the arrow f. As a result, the cloth to be sewn and supported by the carrier (not shown) is also moved rightward and leftward.

The one way clutch 44 permits the feed wheel 30 to rotate in one way with respect to the feed wheel ring 31 when the feed wheel 30 rotates in one way (in the direction of the arrow c shown in FIGS. 4 and 5), and permits the feed wheel 30 to rotate integrally with the feed wheel ring 31 when the feed wheel ring 31 rotates in one way (in the direction of the arrow c shown in FIGS. 4 and 5). More in detail, a housing 38 of the one way clutch 44 is fixed to the feed wheel 30 by screws 39 as shown in FIG. 5, and either of three pawls 40 which are slidably held by the housing 38 while they are displaced in a phase, meshes the teeth 31*b* defined in the inner peripheral surface of the feed wheel ring 31. The teeth 31*b* allows the pawls 40 to rotate by themselves in one way (in the direction of the arrow c), and prevents the pawls 40 from rotating by themselves in another direction (in the direction opposite to the direction denoted by the arrow c). Denoted by 41 are springs for elastically biasing each of the pawls 40 in the outer diameter direction.

Accordingly, when the feed wheel 30 rotates in the direction of the arrow c involved in the rapid feed step, the feed wheel ring 31 does not rotate by the function of the one way clutch 44, thereby allowing the feed wheel 30 to rotate by itself in a state where the spur gear 37 and the bed shaft 17 connected thereto do not rotate. Further, in the sewing step, since the feed wheel ring 31 is rotated by the spur gear 37 in the direction of the arrow c, the feed wheel ring 31 and the feed wheel 30 integrally rotate in the direction of the arrow c by the function of the one way clutch 44.

In such a manner, after the first rapid feed step and the sewing step are sequentially performed, the step moves to the second rapid feed step. The second rapid feed step is performed in the same manner as the first rapid feed step except the movement of the cloth to be sewn in the direction opposite to that in the first rapid feed step, whereby the operation stops at the machine stopping position X so that one cycle of steps is completed.

FIG. 6 shows a feeding mechanism of another conventional eyelet-end buttonhole sewing machine. This mechanism is different from the conventional one shown in FIG. 4 in respect of provision of an electromagnetic clutch 29 to the rapid feed shaft 23 instead of the clutch 27, and a one way clutch 55 between the worm wheel 25 and the pattern wheel shaft 26. This mechanism in FIG. 6 also carries out the same operation as that in FIG. 4 by appropriately engaging or disengaging the mechanical clutch 5 and the electromagnetic clutch 29. The one way clutch 55 allows the pattern wheel shaft gear 28 and the pattern wheel 51 to intermittently rotate in the direction of the arrow f when it is driven by the feed wheel 30 involved in the sewing step.

In either of the conventional mechanisms, two clutches operable by the external motive force, namely, the clutch 5 and the clutch 27 shown in FIG. 4 or the clutch 5 and 29 shown in FIG. 6 are required, as far as the induction motor 60 is employed as a rotation driving source, leading to the problem that cost is increased and the mechanism for engaging or disengaging the clutches 5, 27 and 29 is very complex. Further, since the induction motor 60 always rotates during the operation of the sewing machine, the clutches 5, 27 and 29 need be engaged or disengaged, only when required, which causes a trouble for adjusting an operation timing. Although there exists a feeding mechanism of an eyelet-end buttonhole sewing machine employing an AC servomotor as the rotary driving source, this sewing machine also employs the same feeding mechanism as the conventional one, so that it still has the same problem as the conventional ones, namely, it can not get out of the cost increase and the complex mechanism.

As mentioned above, in the feeding mechanism of the eyelet-end buttonhole sewing machine, two clutches 5, 27 and 29 which are respectively engaged or disengaged by the external motive force are required, so that the cost is increased, and the complex mechanism for the engagement and disengagement thereof is required, which causes a trouble and lowers reliability. Further, only those skilled can repair the trouble.

SUMMARY OF THE INVENTION

The present invention has been made in view of the conventional technical problem and the structure of this invention is as follows.

In the structure of a feeding mechanism of an eyelet-end buttonhole sewing machine according to a first aspect of the invention comprising a bed shaft 17 rotatably supported by a bed 52, a rapid feed shaft 23 rotatably supported by the bed 52, a pattern wheel shaft 26 being rotatably supported by the bed 52 and driven by the rapid feed shaft 23, and a feed wheel 30 being rotatably supported by the bed 52 and driven by the pattern wheel shaft 26 for giving a rapid feed to a cloth to be sewn in a forward and backward direction, and also being rotatably driven by the bed shaft 17 for giving a rapid feed to the cloth to be sewn in a forward and backward direction involved in a sewing step, the feeding mechanism further comprises a rotary driving source 1 being rotatably driven normally and reversely, a bed shaft rotary member 3 being rotatably driven normally and reversely by the rotary driving source 1, a rapid feed rotary member 20 being fixed to the rapid feed shaft 23 and retained by the bed shaft rotary member 3 so as to be reversely rotated therewith, a one way sewing clutch 6 for transmitting only a normal rotation a of the bed shaft rotary member 3 to the bed shaft 17, and a one way rapid feed clutch 43 for transmitting only a reverse rotation b of the bed shaft rotary member 3 to the pattern wheel shaft 26 by way of the rapid feed rotary member 20 and the rapid feed shaft 23.

In the structure of a feeding mechanism of an eyelet-end buttonhole sewing machine according to a second aspect of the invention comprising a bed shaft 17 rotatably supported by a bed 52, a rapid feed shaft 23 rotatably supported by the bed 52, a pattern wheel shaft 26 being rotatably supported by the bed 52 and driven by the rapid feed shaft 23, and a feed wheel 30 being rotatably supported by the bed 52 and driven by the pattern wheel shaft 26 for giving a rapid feed to a cloth to be sewn in a forward and backward direction, and also being rotatably driven by the bed shaft 17 for giving a rapid feed to the cloth to be sewn in a forward and backward direction involved in a sewing step, the feeding mechanism further comprises a rotary driving source 1 being rotatably driven normally and reversely, a bed shaft rotary member 3 being normally and reversely by the rotary driving source 1, a rapid feed rotary member 20 being fixed to the rapid feed shaft 23 and retained by the bed shaft rotary member 3 so as to be reversely rotated therewith, a sewing electromagnetic clutch 7 for transmitting only a normal rotation a of the bed shaft rotary member 3 to the bed shaft 17, and a one way rapid feed clutch 43 for transmitting only a reverse rotation b of the bed shaft rotary member 3 to the pattern wheel shaft 26 by way of the rapid feed rotary member 20 and the rapid feed shaft 23.

In the structure of a feeding mechanism of an eyelet-end buttonhole sewing machine according to a third aspect of the invention, the rotary driving shaft source 1 comprises an AC servomotor.

BRIEF DESCRIPTION OF THE DRAWINGS

These and other features, aspects, and advantages of the present invention will become better understood with regard to the following description, appended claims, and accompanying drawings where:

PREFERRED EMBODIMENT OF THE INVENTION

Figure 3:
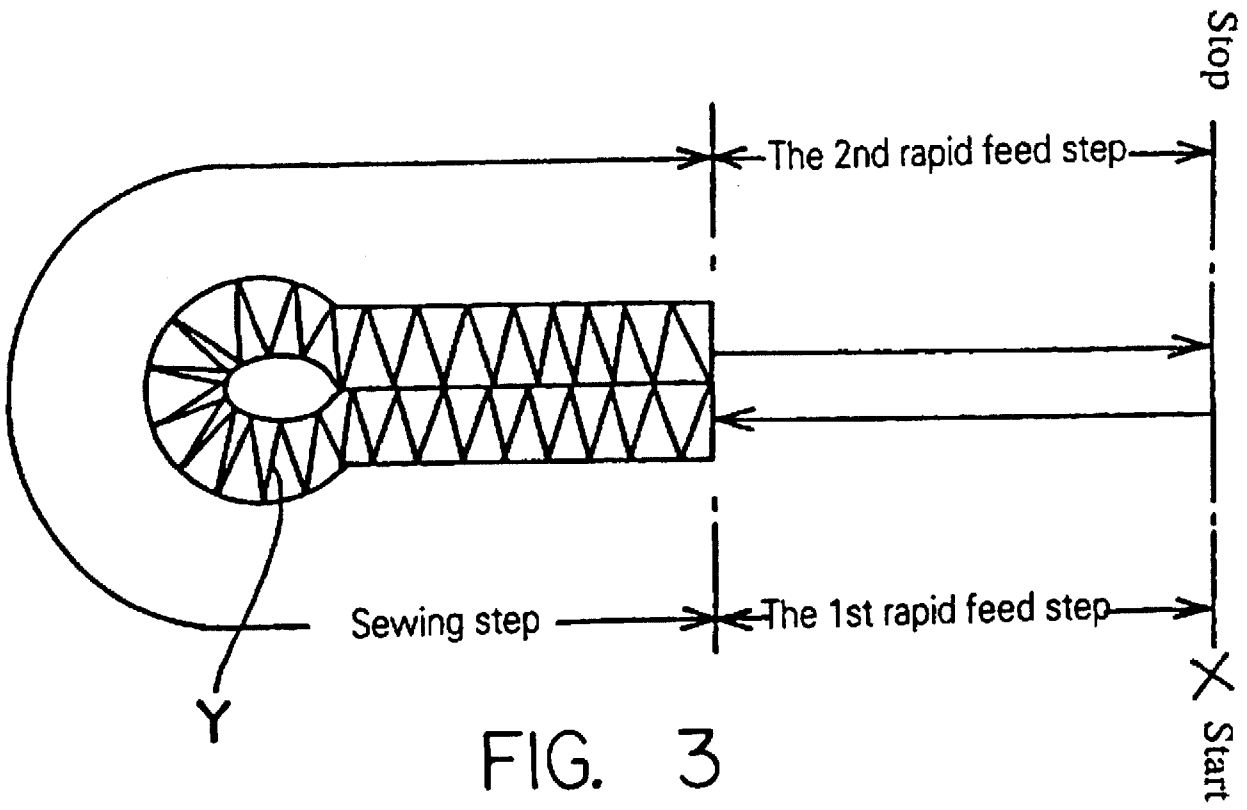
FIG. 3 shows the stitching pattern made using the feeding mechanisms for an eyelet-end buttonhole sewing machine of FIGS. 1 and 2.
Figure 4:
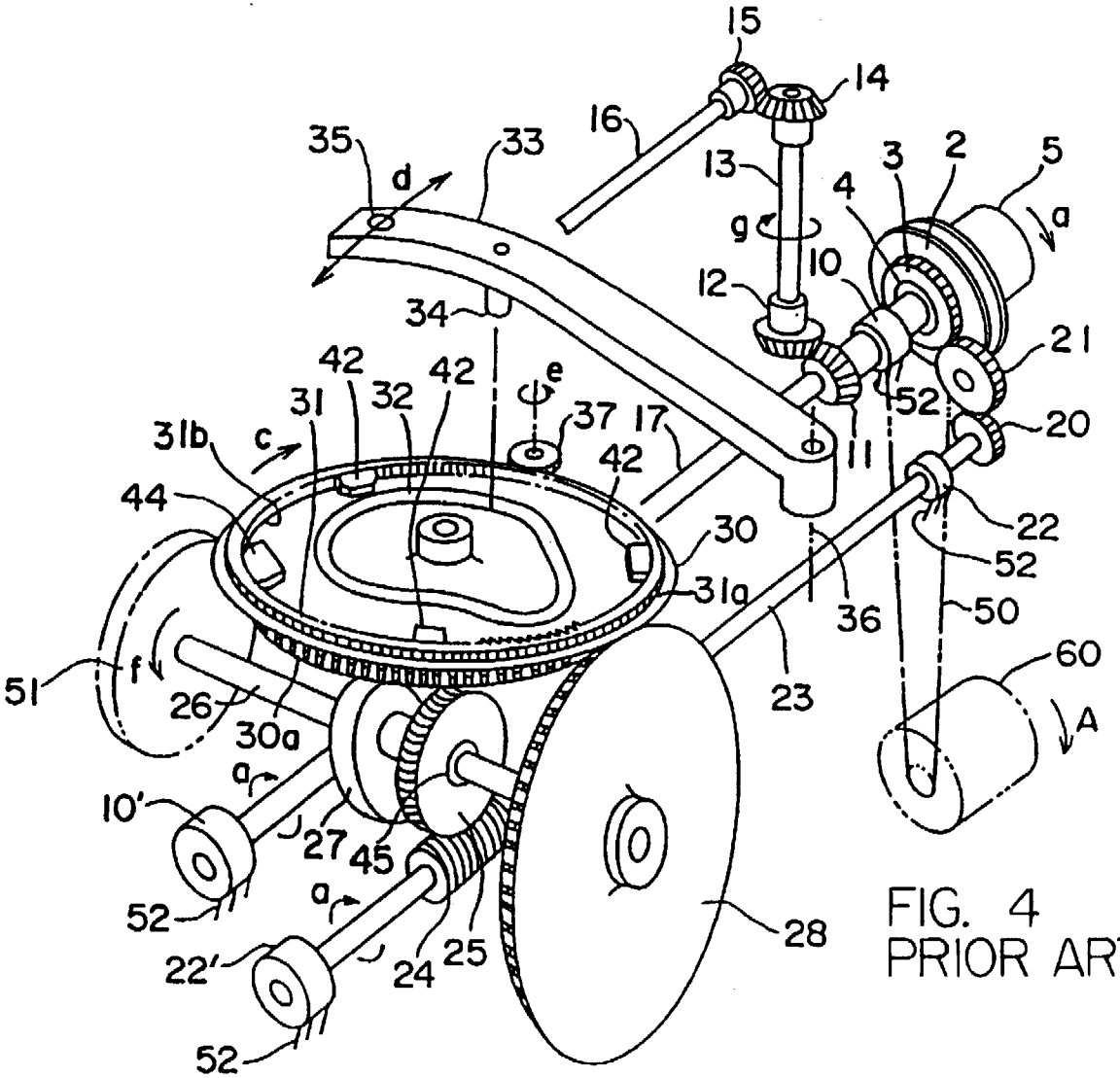
FIG. 4 PRIOR ART
FIG. 4 is a perspective view of a Prior Art feeding mechanism for an eyelet-end buttonhole sewing machine.
Figure 5:
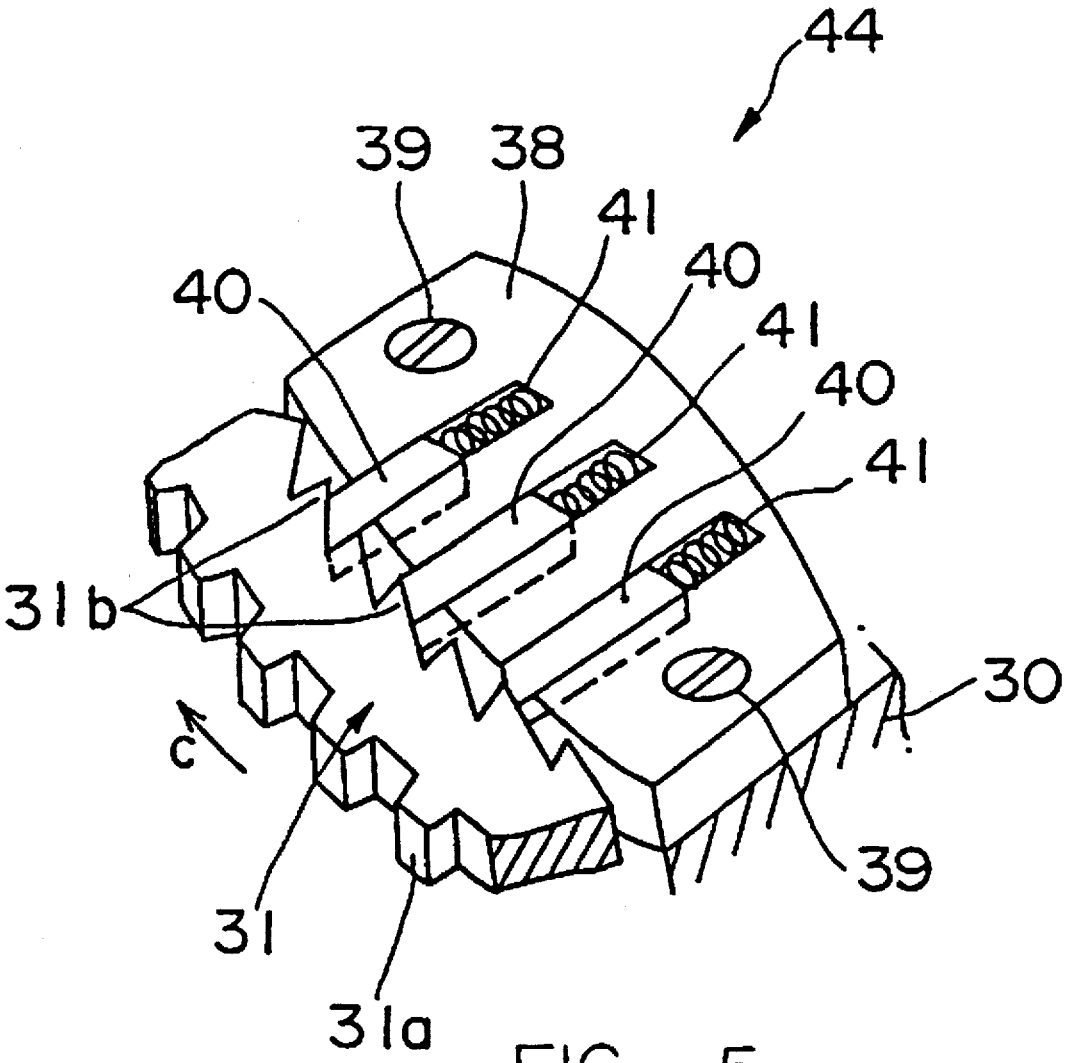
FIG. 5 is a perspective view of a one-way clutch employed by the eyelet-end buttonhole sewing machine invention of the present invention.
Figure 6:
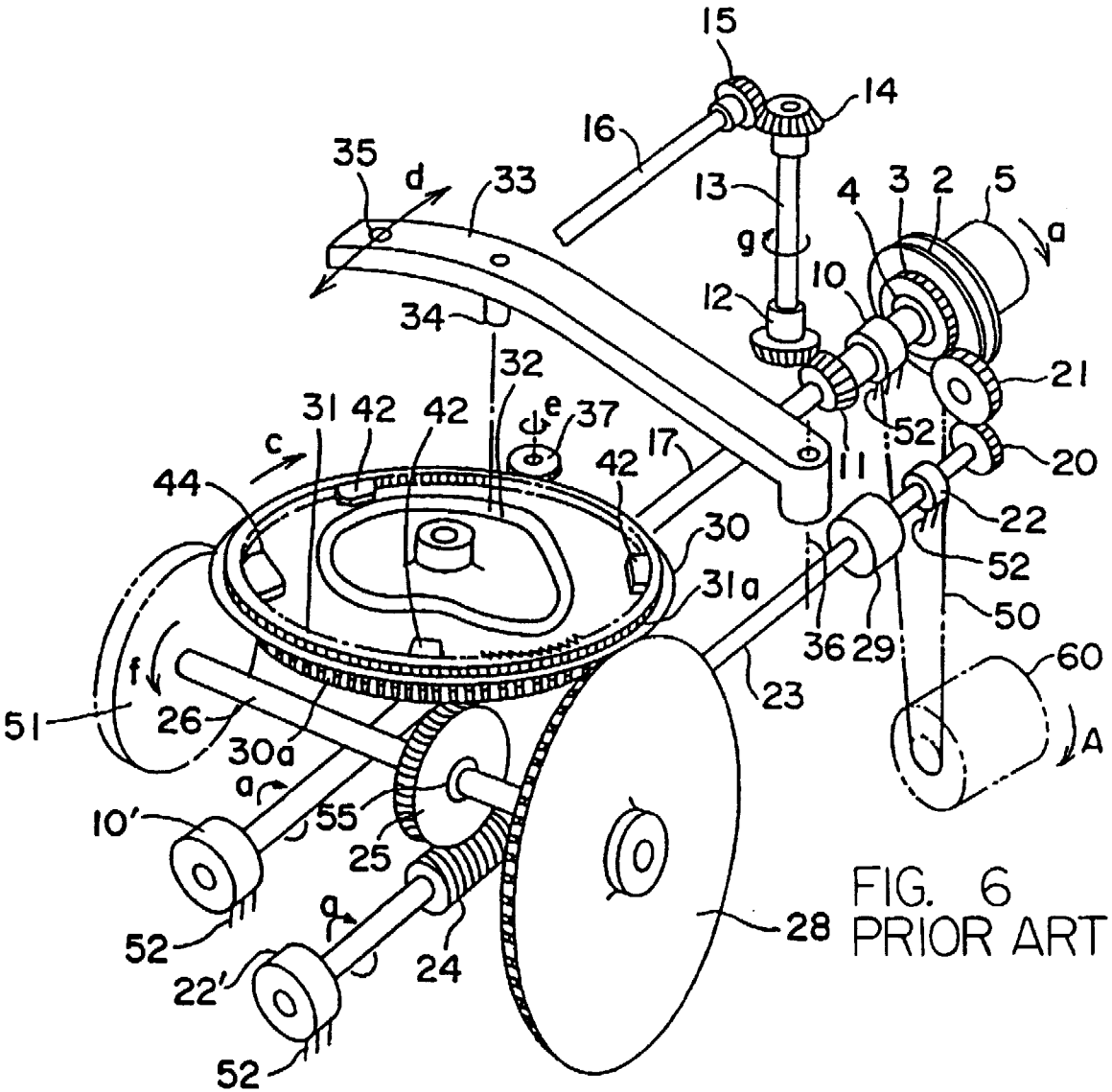
FIG. 6 PRIOR ART
FIG. 6 is a perspective view of a Prior Art feeding mechanism for an eyelet-end buttonhole sewing machine of the present invention.

First Embodiment (FIG. 1):

A feeding mechanism of an eyelet-end buttonhole sewing machine according to a first embodiment will be now described with reference to FIGS. 1 and 3. Constituents having the same function as the conventional ones are denoted by the same numerals, and the explanation thereof is omitted.

In the feeding mechanism of an eyelet-end buttonhole sewing machine according to the fist embodiment, the rotary driving source 1 which can be normally and reversely rotated is employed instead of the conventional induction motor 60. An AC servomotor is employed as the rotary driving source 1. The AC servomotor is characterized in that it is excellent in normal and reverse rotations and a positioning control characteristic. The commercially available one way rapid feed clutch 43 and the one way sewing clutch 6 are used instead of the conventional clutches 5 and 27, and the electromagnetic clutch 29. Further, the conventional idle gear 21 is omitted, and the rotation of the bed shaft gear 3 is reversed to transmit torque to the rapid feed shaft gear 20. That is, as shown in FIG. 1, the bed shaft gear 3 fixed to the pulley 2 directly meshes the rapid feed shaft gear 20 fixed to the rapid feed shaft 23.

The pulley 2 and the bed shaft gear 3 are respectively supported by the bed shaft 17 by way of the commercially available one way sewing clutch 6. The one way sewing clutch 6 transmits rotation torque to the bed shaft 17 when the pulley 2 and the bed shaft gear 3 are normally rotated (shown by the arrow a in FIG. 1) owing to the normal rotation of the rotary driving source 1 (shown by an arrow A in FIG. 1). However, the one way sewing clutch 6 can not transmit the rotation torque to the bed shaft 17 when the rotary driving source 1 is rotated reversely (denoted by an arrow B in FIG. 1), and hence it rotates freely. When the rotary driving source 1 and the bed shaft gear 3 rotate reversely (in the direction of the arrows B and b), the rapid feed shaft gear 20 rotates normally (in the direction of the arrow a).

The worm wheel 25 is supported by the pattern wheel shaft 26 by way of the commercially available one way rapid feed clutch 43. The one way rapid feed clutch 43 is locked when the rapid feed gear 3 and rapid feed shaft 23 normally rotate (in the direction of the arrow a) owing to the reverse rotation (in the direction of the arrow B) of the rotary driving source 1, thereby transmitting the rotation torque to the rapid feed shaft 23 so as to apply the rotation (in the direction of the arrow f) to the pattern wheel shaft 26. When the rapid feed shaft gear 20 and rapid feed shaft 23 are reversely rotated (in the direction of the arrow b) in FIG. 1 owing to the normal rotation A of the rotary driving source 1, the rotation torque of the worm wheel 25 meshing the worm 24 cannot be transmitted to the pattern wheel shaft 26 so that the one way rapid feed clutch 43 rotates freely.

The function of the first embodiment will be described now.

In the first rapid feed step, the rotary driving source 1 is reversely rotated (in the direction of the arrow B). If the rotary driving source 1 is reversely rotated, the pulley 2 and the bed shaft gear 3 are also reversely rotated (in the direction of the arrow b). However, the one way sewing clutch 6 rotates freely between itself and the bed shaft 17 so that the rotation torque of the bed shaft gear 3 cannot be transmitted to the bed shaft 17. Meanwhile, if the pulley 2 and the bed shaft gear 3 are reversely rotated (in the direction of the arrow b) owing to the reverse rotation (in the direction of the arrow B) of the rotary driving source 1, the one way rapid feed clutch 43 is locked so that the rotation torque of the rapid feed shaft 23 is transmitted to the pattern wheel shaft 26, thereby performing the first rapid feed step. That is, if the bed shaft gear 3 is reversely rotated (in the direction of b), the rapid feed shaft gear 20, the rapid feed shaft 23 and the worm 24 are normally rotated (in the direction of a) so that the worm wheel 25 and the pattern wheel shaft 26 are respectively rotated in the direction of the arrow f by way of the locked one way rapid feed clutch 43.

Figure 1:
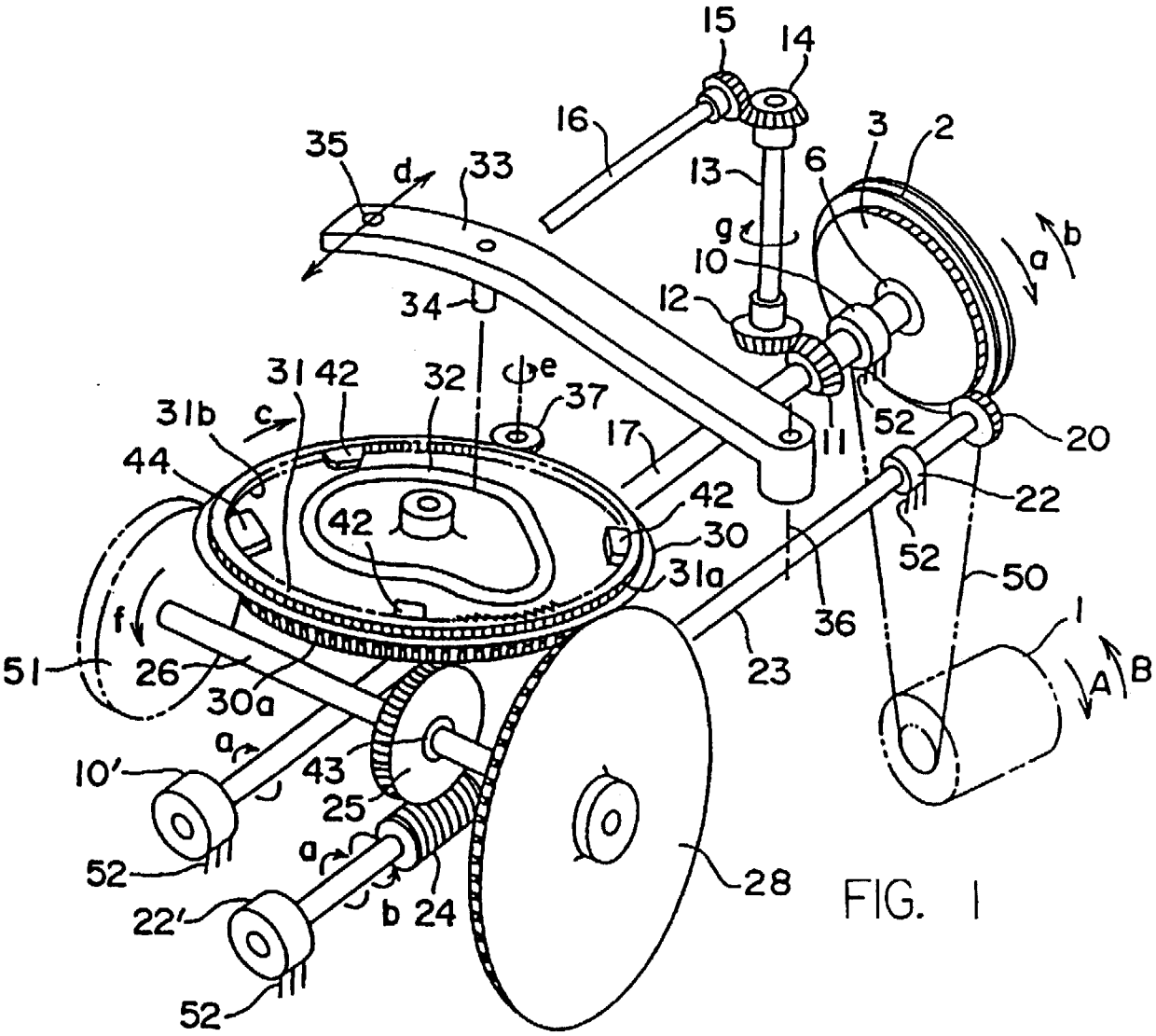
FIG. 1 is a perspective view of the feeding mechanism for an eyelet-end buttonhole sewing machine of the present invention.

If the pattern wheel shaft 26 is rotated in the direction of the arrow f, the pattern wheel shaft gear 28 fixed to the one end of the pattern wheel shaft 26 is rotated likewise, and the feed wheel 30 having the bevel gear 30*a* at the outer peripheral surface which meshes the pattern wheel shaft gear 28 is rotated in the direction of the arrow c in FIG. 1. When the feed wheel 30 is rotated in the direction of the arrow c, the feed wheel ring 31 and the spur gear 37 do not rotate owing to the function of the one way clutch 44.

When the feed wheel 30 is rotated in the direction of the arrow c, the carrier bar 33 is swingably operated in the forward and backward direction (in the direction of the arrow d in FIG. 1) along the groove 32. As a result, the carrier is operated in the forward and backward direction using the hole 35 of the carrier bar 33, so as to perform the first rapid feed step for moving the cloth to be sewn.

Successively, when the sewing step starts upon completion of the first rapid feed step, the rotary driving source 1 is reversely rotated in the normal direction (in the direction of the arrow A). If the rotary driving source 1 is normally rotated (in the direction of the arrow A), the pulley 2 and the bed shaft gear 3 are also normally rotated (in the direction of the arrow a) so that the one way sewing clutch 6 is locked and the bed shaft 17 is normally rotated in the direction of the arrow a as shown in FIG. 17. Accordingly, the spur gear 37 is rotatably driven by the vertical shaft 13 which is rotated in the direction of the arrow g so that the forward and backward feeding of the cloth to be sewn is started in the sewing step. The spur gear 37 is intermittently driven in the direction of the arrow e by way of the geneva gear apparatus, etc. At this time, since the rapid feed shaft 23 is rotated by the rapid feed shaft gear 20 meshing the bed shaft gear 3, the worm wheel 25 also rotates. However, the rapid feed shaft gear 20 and the worm 24 are reversely rotated (in the direction of the arrow b), the one way rapid feed clutch 43 rotates freely so that the rotation torque is not transmitted to the pattern wheel shaft 26. As a result, the first rapid feed step is not performed. When the arm shaft 16 is rotated owing to the normal rotation (in the direction of the arrow a) of the bed shaft 17, the needle bar (not shown) connected to the arm shaft 16 and the looper (not shown) connected to the bed shaft 17 is also driven.

Since the spur gear 37 meshes the teeth 31*a* defined in the outer peripheral surface of the feed wheel ring 31, the feed wheel ring 31 is intermittently rotated in the direction of the arrow c shown in FIG. 1. The feed wheel 30 is integrally rotated with the feed wheel ring 31 by way of the one way clutch 44 owing to the intermittent rotation of the feed wheel ring 31 in the direction of the arrow c. When the feed wheel ring 31 and the feed wheel 30 are intermittently rotated in the direction of the arrow c, the carrier bar 33 is swingably operated in the forward and backward direction (in the direction of the arrow d in FIG. 1) along the groove 32 of the feed wheel 30 so that the carrier for moving the cloth to be sewn in the forward and backward direction is operated using the hole 35 as set forth above. As a result, the sewing step is performed while the cloth to be sewn is moved in the forward and backward direction, and the needle bar connected to the arm shaft 16 and the looper connected to the bed shaft 17 are respectively driven. The pattern wheel shaft gear 28 meshing the bevel gear 30*a* is also intermittently rotated owing to the intermittent rotation of the feed wheel 30 in the direction of the arrow c so that the pattern wheel shaft 26 and the pattern wheel 51 are respectively intermittently rotated in the direction of the arrow f, as a result, the cloth to be sewn which is supported by the carrier (not shown) is also moved to the right and left. At this time, the one way rapid feed clutch 43 rotates freely. Then, the step moves to the second rapid feed step upon completion of the sequential performance of the first rapid feed step and the sewing step. The second rapid feed step is performed in the same manner as the first rapid feed step, whereby the operation stops at the machine stopping position X so that one cycle of the steps is completed.

In such a manner, the sewing step and the first and second rapid feed step can be simply controlled using the two one way sewing clutches 6 and the one way rapid feed clutch 43, meshing the rapid feed shaft gear 20 with respect to the bed shaft gear 3 so as to be reversely rotated, and switching the rotary driving source 1 in the forward and reverse rotating directions (in the direction of the arrows A and B). If the AC servomotor is employed as the rotary driving source 1, the feeding mechanism by the necessary rotating amount in the forward and reverse directions can be accurately operated, when needed, thereby allowing the feeding control to be simple and accurate.

Figure 2:
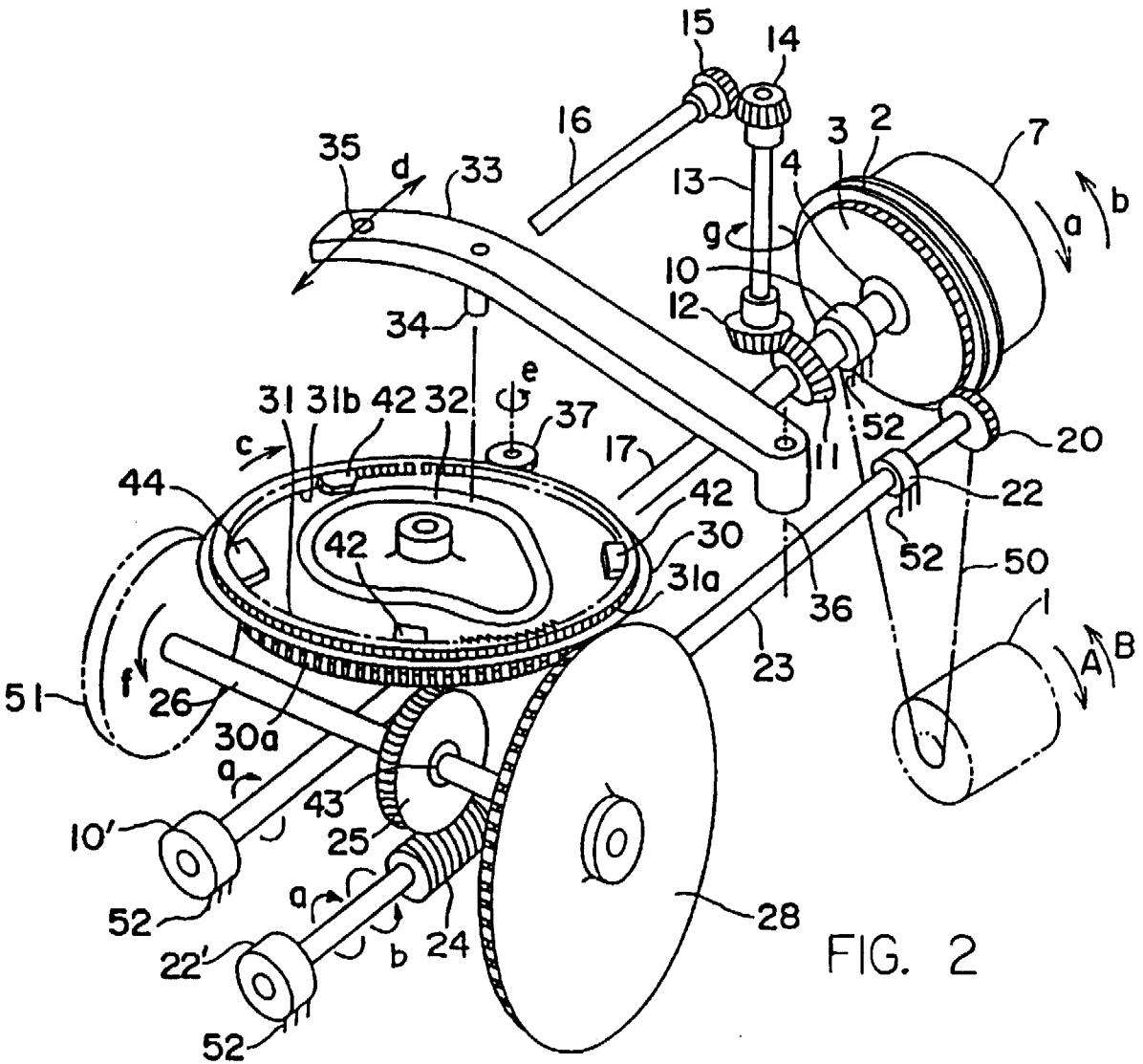
FIG. 2 is a perspective view of an alternative embodiment of the feeding mechanism for an eyelet-end buttonhole sewing machine of FIG. 1.

Second Embodiment (FIGS. 2 and 3):

A feeding mechanism of an eyelet-end buttonhole sewing machine according to a second embodiment will be now described with reference to FIGS. 2 and 3. Constituents having the same function as the first embodiment are denoted by the same numerals, and the explanation thereof is omitted.

In the second embodiment, a clutch 7 which can be engaged or disengaged by an external motive force is mounted on the bed shaft 17 instead of the one way sewing clutch 6 of the first embodiment. The sewing electromagnetic clutch 7 is fixed to the pulley 2.

The sewing electromagnetic clutch 7 is provided for the performance of a mechanical operation (for example, cutting mechanical operation) as well as the performance of the first and second rapid feed steps and the sewing step when the rotary driving source 1 comprising the AC servomotor is driven, that is, the pulley 2 and the bed shaft gear 3 are rotatably attached to the bed shaft 17 by way of the bearing 4, and the sewing electromagnetic clutch 7 is engaged so as to transmit the rotation torque to the bed shaft 17 only when the rotary driving source 1 carries out the normal rotation A for performing the sewing step. At this time, the rapid feed step is not performed by the function of the one way rapid feed clutch 43 in the same manner as the first embodiment. Further, in the rapid feed step, the sewing electromagnetic clutch 7 is disengaged so that the rotation torque of the pulley 2 and the bed shaft gear 3 do not transmit to the bed shaft 17. In this state, when the rotary driving source 1 is subject to the reverse rotation B, the rapid feed step is performed in the same manner as the first embodiment.

Further, when the other mechanism is operated, the sewing electromagnetic clutch 7 is disengaged and a clutch with the other mechanism, not shown, is engaged. In this state, if the rotary driving source 1 is subject to the normal rotation A, the other mechanism alone can be operated. Neither the sewing step nor the rapid feed step is not performed during the operation of the other mechanism owing to the functions of the sewing electromagnetic clutch 7 and the one way rapid feed clutch 43. According to the second embodiment, although one clutch 7 is needed instead of the one way sewing clutch 6 compared with the first embodiment, the clutch which is engaged or disengaged by the external motive force is reduced by one, leading to the cost down and the simplification of the mechanism.

Whereupon, the bed shaft gear 3 and the rapid feed shaft gear 20 may have such a function to reversely rotate the bed shaft gear 3 so as to transmit the rotation torque to the rapid feed shaft gear 20, and hence an even number of idle gears can be interposed between the bed shaft gear 3 and the rapid feed shaft gear 20. Further, the bed shaft gear 3 and the rapid feed shaft gear 20 may be employed in such a manner that the bed shaft gear 3 is reversely rotated to transmit the rotation torque to the rapid feed shaft gear 20 and they may be composed of an entraining transmission system using a chain or a belt. It is needless to say that the bed shaft gear 3 and the rapid feed shaft gear 20 may be composed of an entraining transmission system using a timing belt. Accordingly, the bed shaft gear 3 may be composed of a bed shaft rotary member such as a gear, a sprocket, a pulley, and the rapid feed shaft gear 20 may be composed of a rapid feed shaft rotary member such as a gear, a sprocket, a pulley wherein the bed shaft rotary member is reversely rotated to transmit the rotation torque thereof to the rapid feed rotary member.

The worm 24 and the worm wheel 25 may function in such a manner that the rotation of the rapid feed shaft 23 is transmitted to the pattern wheel shaft 26 at a given speed reducing ratio, and hence they may be composed of a gear mechanism or system such as bevel gears.

As is evident from the above explanation, according to the feeding mechanism of an eyelet-end buttonhole sewing machine of the present invention, the rotary driving source capable of switching to the normal and reverse rotation is used for driving the feeding mechanism, and the rapid feed rotary member which is fixed to the rapid feed shaft is retained by the bed shaft rotary member so as to be reversely rotated therewith. As a result, it is possible to feed two kinds of cloths by switching between the normal and reverse rotation by way of two one way clutches instead of two mechanical or electric clutches which were needed for switching a feeding method of two kinds of clothes in the sewing step and the rapid feed steps. As a result, the following effects can be obtained.

Since the number of expensive clutches which can be engaged or disengaged by the external motive force can be reduced, the feeding mechanism including devices for operating the clutch can be simplified as a whole. As a result, the feeding mechanism of an eyelet-end buttonhole sewing machine is also simplified in the maintenance thereof and can be easily repaired without resorting to a skilled art. Since the cloth feeding mechanism is simplified, it is hardly troubled, thereby improving the reliability thereof.

Further, according to the first aspect of the invention, two one way clutches alone are mounted so as to switch between the normal and reverse rotations of the rotary driving source, thereby performing the feeding of two kinds of cloths by switching thereof. Accordingly, the feeding mechanism can be further simplified, which dispenses with the adjustment of timing.

What is claimed is:

1. A feeding mechanism of an eyelet-end buttonhole sewing machine comprising a bed shaft rotatably supported by a bed, a rapid feed shaft rotatably supported by the bed, a pattern wheel shaft being rotatably supported by the bed and driven by the rapid feed shaft, and a feed wheel being rotatably supported by the bed and driven by the pattern wheel shaft for giving a rapid feed to a cloth to be sewn in a forward and backward direction, and also being rotatably driven by the bed shaft for giving a rapid feed to the cloth to be sewn in a forward and backward direction involved in a sewing step, the feeding mechanism further comprising:

a rotary driving source being rotatably driven normally and reversely;

a bed shaft rotary member being rotatably driven normally and reversely by the rotary driving source;

a rapid feed rotary member being fixed to the rapid feed shaft and retained by the bed shaft rotary member so as to be reversely rotated therewith;

a one way sewing clutch for transmitting only normal rotation of the bed shaft rotary member to the bed shaft; and a one way rapid feed clutch for transmitting only a reverse rotation of the bed shaft rotary member to the pattern wheel shaft by way of the rapid feed rotary member and the rapid feed shaft.

2. A feeding mechanism of an eyelet-end buttonhole sewing machine comprising a bed shaft rotatably supported by a bed, a rapid feed shaft rotatably supported by the bed, a pattern wheel shaft being rotatably supported by the bed and driven by the rapid feed shaft, and a feed wheel being rotatably supported by the bed and driven by the pattern wheel shaft for giving a rapid feed to a cloth to be sewn in a forward and backward direction, and also being rotatably driven by the bed shaft for giving a rapid feed to the cloth to be sewn in a forward and backward direction involved in a sewing step, the feeding mechanism further comprising:

a rotary driving source being rotatably driven normally and reversely;

a bed shaft rotary member being normally and reversely by the rotary driving source;

a rapid feed rotary member being fixed to the rapid feed shaft and retained by the bed shaft rotary member so as to be reversely rotated therewith;

a sewing electromagnetic clutch for transmitting only a normal rotation of the bed shaft rotary member to the bed shaft; and a one way rapid feed clutch for transmitting only a reverse rotation of the bed shaft rotary member to the pattern wheel shaft by way of the rapid feed rotary member and the rapid feed shaft.

3. A feeding mechanism of an eyelet-end buttonhole sewing machine according to claim 1, wherein the rotary driving source comprises an AC servomotor.

* * * * *